US008640277B1

(12) United States Patent
Alba

(10) Patent No.: US 8,640,277 B1
(45) Date of Patent: Feb. 4, 2014

(54) BODY SCRUBBER

(76) Inventor: Ricardo Alba, Tolleson, AZ (US)

( * ) Notice: Subject to any disclaimer, the term of this patent is extended or adjusted under 35 U.S.C. 154(b) by 900 days.

(21) Appl. No.: 12/757,550

(22) Filed: Apr. 9, 2010

Related U.S. Application Data

(60) Provisional application No. 61/167,889, filed on Apr. 9, 2009.

(51) Int. Cl.
*A47K 7/02* (2006.01)

(52) U.S. Cl.
USPC ..... 4/606

(58) Field of Classification Search
USPC ..... 4/605, 606
See application file for complete search history.

(56) References Cited

U.S. PATENT DOCUMENTS 2,068,757 A * 1/1937 Mishelle ..... 4/606
3,196,867 A * 7/1965 Perry ..... 601/114
4,040,132 A * 8/1977 Braun ..... 4/606
4,858,257 A * 8/1989 Bivens ..... 4/606
5,561,869 A 10/1996 Sarel
6,996,861 B1 2/2006 Clark, Jr.
7,062,815 B1 6/2006 Richardson
7,451,513 B2 11/2008 Torres
2009/0241257 A1 10/2009 Malta

* cited by examiner

*Primary Examiner* — Huyen Le
(74) *Attorney, Agent, or Firm* — Kenneth L Tolar

(57) ABSTRACT

A body scrubber includes a housing having two opposing sides, a top, a bottom and an open front face. Positioned within the open front face are a plurality of tiered, motorized cleansing rollers each formed of a hollow, perforated tube encapsulated by an absorbent cleansing sleeve. Either soap or water can be delivered to the interior of each tube using a control panel. A bather first delivers soap to the rollers and places a desired portion of the body against the motorized cleansing sleeves; when the soap has been thoroughly applied, the bather delivers water to rinse the applied soap. Accordingly, a bather may easily cleanse certain bodily areas that would otherwise be inaccessible with conventional cleaning implements.

6 Claims, 2 Drawing Sheets

BODY SCRUBBER

CROSS REFERENCE TO RELATED APPLICATIONS

This application is entitled to the benefit of provisional application No. 61/167,889 filed on Apr. 9, 2009, the specification of which is incorporated herein by reference.

BACKGROUND OF THE INVENTION

The present invention relates to a body scrubber that allows a bather to more easily wash the back and other hard-to-reach areas.

DESCRIPTION OF THE PRIOR ART

The elderly, infirm or those suffering from injuries often struggle to wash the back and other areas of the body. Though elongated brushes have been designed to address this problem, they are only marginally effective. Accordingly, there is currently a need for a device that allows a bather to more easily cleanse certain areas of the body.

U.S. Pat. No. 6,996,861 issued to Clark, Jr. discloses a shower massaging and cleaning apparatus comprising a housing suspended from a shower head having three brush sections thereon. Each section is formed of multiple brushes that are rotated with a variable-speed motor. A soap dispenser delivers soap from an integral dispenser to each section.

U.S. Pat. No. 7,062,815 issued to Richardson discloses a back scrubber including a U-shaped bracket having a motorized, tubular brush member removably mounted therebetween.

U.S. Pat. No. 4,040,132 issued to Braun discloses a back scrubber including an open casing embedded within a shower stall; a plurality of motorized, cylindrical scrubbers protrude from the casing for scrubbing a bather's back.

U.S. Pat. No. 5,561,869 issued to Sarel discloses a body washer including a rack secured to a shower wall having a brush housing adjustably mounted thereon. Water is diverted from the shower head to internal impellers that drive rotatable cleaning brushes on the housing exterior. A soap dispenser injects soap into the water supply.

U.S. Patent no. application 20090241257 issued to Malta discloses a shower back scrubber including a pair of rotating, vertically-reciprocating brushes mounted on a shower wall.

U.S. Pat. No. 7,451,513 issued to Torres discloses a back scrubbing and cleaning apparatus including a housing having suction cups on a rear surface for attaching the device to a shower wall; on the front surface are a plurality of motor-driven scrubbing brushes.

As indicated above, several scrubbing devices having motorized cleaning elements exist in the prior art. However, none of the prior art references include a means for selecting a desired wash mode such as "rinse" or "foam" or for operating various components remotely. Accordingly, a user must be immediately adjacent the scrubber in order to control a cleansing cycle. The present invention overcomes the deficiencies associated with the prior art devices by providing a body scrubber having a controller in communication with a remote unit that allows a user to select a "rinse" or "foam" mode either locally or remotely.

SUMMARY OF THE INVENTION

The present invention relates to a body scrubber including a housing having two opposing sides, a top, a bottom and an open front face. Positioned within the open front face are a plurality of tiered, motorized cleansing rollers each formed of a hollow, perforated tube encapsulated by an absorbent cleansing sleeve. Either soap or water can be delivered to the interior of each tube using a control panel. A bather first delivers soap to the rollers and places a desired portion of the body against the motorized cleansing sleeves; when the soap has been thoroughly applied, the bather delivers water to rinse the applied soap. Accordingly, a bather may easily cleanse certain bodily areas that would otherwise be inaccessible with conventional cleaning implements.

It is therefore an object of the present invention to provide a body scrubber that allows a bather to more easily access certain areas of the body.

It is another object of the present invention to provide a body scrubber that assists physically-challenged people with scrubbing certain areas of the body.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
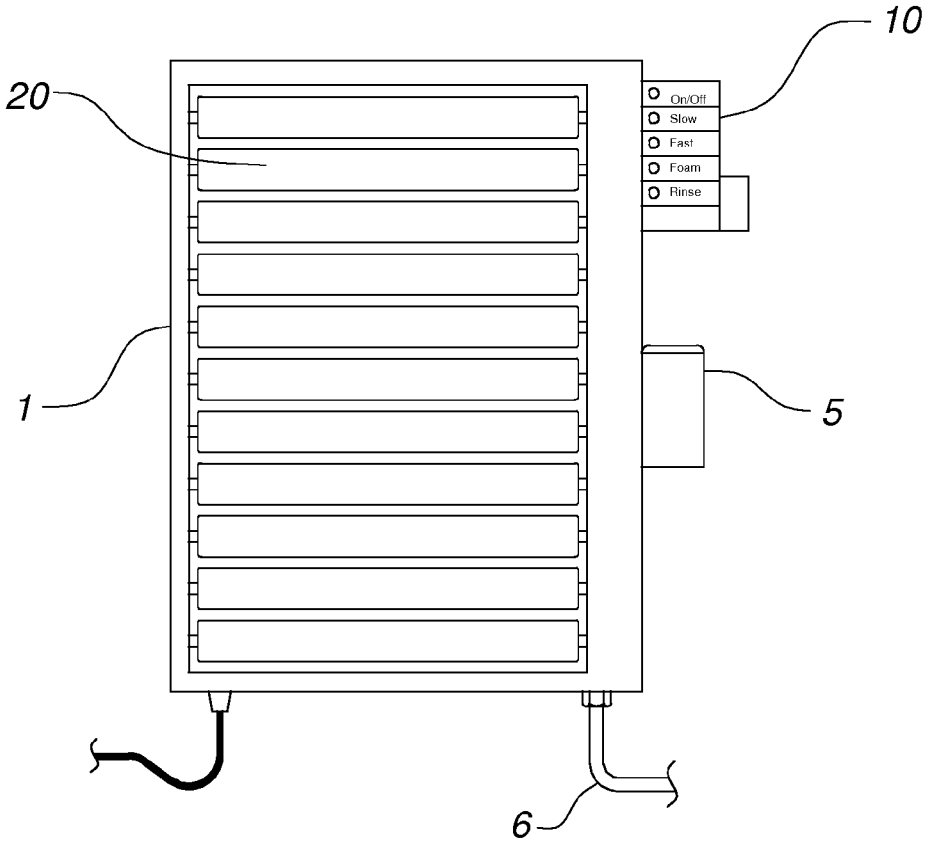
FIG. 1 is a front, plan view of the body scrubber according to the present invention.
Figure 2:
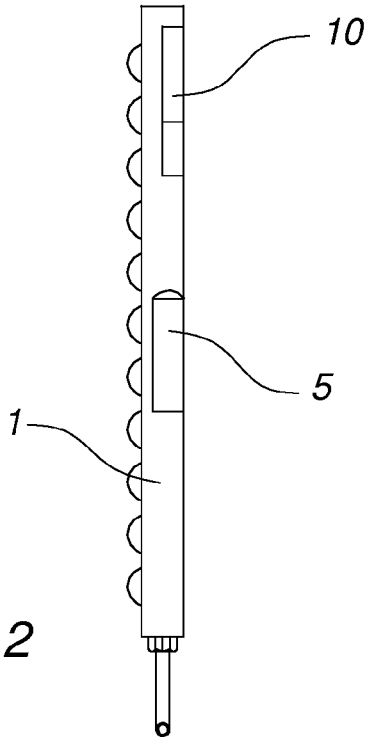
FIG. 2 is a side view of the body scrubber.
Figure 3:
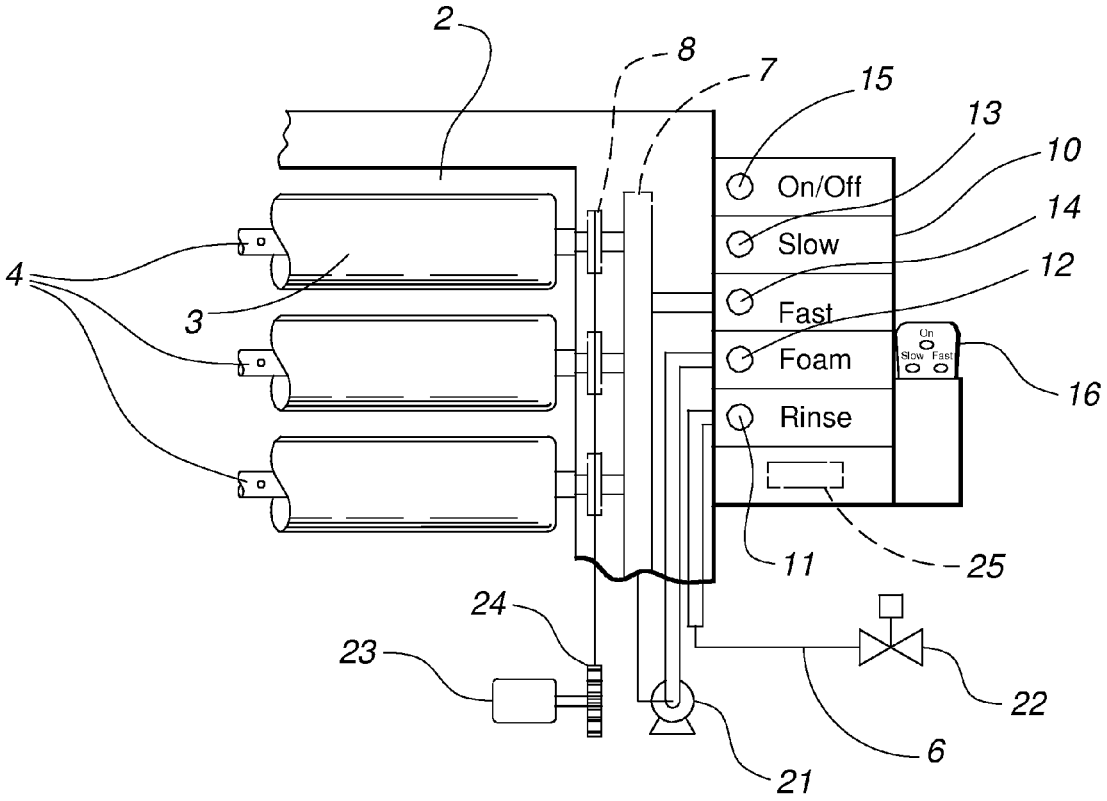
FIG. 3 is a sectional view of the housing.
Figure 4:
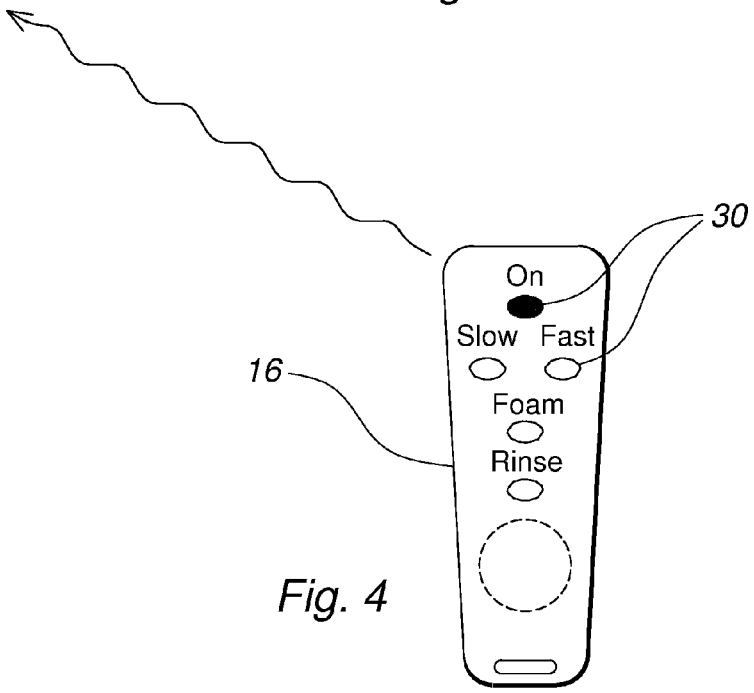
FIG. 4 depicts the remote unit.

The present invention relates to a body scrubber including a housing 1 having two opposing sides, a top, a bottom and an open front face 2. Positioned within the open front face are a plurality of tiered, horizontal cleansing rollers 20 each formed of a hollow, perforated tube 4 encapsulated by a sleeve 3. Preferably, each sleeve is constructed with an absorbent, loofah sponge or similar material.

A manifold system 7 establishes fluid communication between each tube interior and both a soap reservoir 5 and a water source 6. A pump 21 delivers soap from the reservoir to each tube while a solenoid valve 22 controls water flow. A drive gear 8 is mounted on an end of each tube; a reversible, variable-speed motor 23 drives an intermediate gearing system 24 that cooperates with each of the drive gears to rotate the tubes in either of two directions.

A switch panel 10 in communication with a microcontroller controls the soap pump speed, the supply water solenoid valve and the motor speed. A user may, therefore, select a "rinse" 11 mode, a "foam" 12 mode, a "slow" 13 or "fast" 14 mode to vary the speed of the rollers or a disable 15 mode. The microcontroller includes a receiver 25 that is in select wireless communication with a remote unit 16 allowing the various modes to be selected remotely, if desired. As such, the remote unit includes a plurality of control switches 30 corresponding to the pertinent control switches 11,12,13,14,15 on the switch panel.

Accordingly, a bather first selects the "foam" mode and places a desired portion of the body against the rollers; when the soap has been thoroughly applied, the bather selects the "rinse" mode to deliver water to the tube interior and subsequently to the sponge. Once the bather has sufficiently rinsed the cleansed area, the device is disabled at which time the controller rinses the tubes for a predetermined duration to prepare them for later use. Preferably, the controller is preprogrammed to actuate the motor in a first direct for a predetermined duration and subsequently reverse the motor for another predetermined direction. Accordingly, the rollers will complete a specified number of revolutions in one direction and then an equal number of revolutions in an opposite direction to optimize scrubbing.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A body scrubber comprising:

a housing having an open front face;

a plurality of tiered, horizontal cleansing rollers positioned within the open front face, each of said rollers including a hollow, perforated tube encapsulated by an absorbent sleeve;

a soap source in fluid communication with each of said rollers;

a water source in fluid communication with each of said rollers;

means for rotating each of said rollers at a desired speed;

means for delivering water from said water source and soap from said soap source to said rollers for a desired duration to cleanse a bather's body.

2. The body scrubber according to claim 1 wherein said means for rotating each of said sleeves at a desired speed comprises:

a variable-speed motor;

a gearing assembly operably connected to said motor and to each of said sleeves.

3. The body scrubber according to claim 2 wherein said means for delivering water from said water source and soap from said soap source to said rollers for a desired duration comprises:

a pump in fluid communication with said soap source and each of said rollers;

a control valve in communication with said water source and each of said rollers;

a microcontroller in communication with said control valve and said pump, said microcontroller having a first control switch for activating either of said valve and said pump for a desired duration.

4. The body scrubber according to claim 3 wherein said microcontroller includes a second control switch in communication with said motor for varying an operational speed thereof.

5. The body scrubber according to claim 3 further comprising:

a wireless receiver in communication with said microcontroller;

a remote unit in discrete wireless communication with said receiver, said remote unit having a first control button for remotely activating either of said pump and said valve and a second control button for remotely activating said motor to operate at a desired speed.

6. The body scrubber according to claim 3 wherein said microcontroller is preprogrammed to actuate the motor in a first direct for a predetermined duration and subsequently reverse the motor for a second predetermined direction whereby the rollers will complete a specified number of revolutions in one direction and then an equal number of revolutions in an opposite direction to optimize scrubbing.

* * * * *